US010636600B2

(12) United States Patent
Tanaka et al.

(10) Patent No.: US 10,636,600 B2
(45) Date of Patent: Apr. 28, 2020

(54) ELECTROMAGNETIC RELAY

(71) Applicant: EM Devices Corporation, Shiroishi-shi (JP)

(72) Inventors: Yoshiki Tanaka, Shiroishi (JP); Tsutomu Ono, Shiroishi (JP); Jun Konda, Shiroishi (JP); Kenichi Herai, Shiroishi (JP); Yuta Suzuki, Shiroishi (JP)

(73) Assignee: EM DEVICES CORPORATION, Shiroishi-Shi (JP)

( * ) Notice: Subject to any disclaimer, the term of this patent is extended or adjusted under 35 U.S.C. 154(b) by 113 days.

(21) Appl. No.: 15/821,126

(22) Filed: Nov. 22, 2017

(65) Prior Publication Data

US 2018/0261413 A1 Sep. 13, 2018

(30) Foreign Application Priority Data

Mar. 10, 2017 (JP) ..... 2017-045836

(51) Int. Cl.
*H01H 13/04* (2006.01)
*H01H 50/02* (2006.01)
(Continued)

(52) U.S. Cl.
CPC ..... *H01H 50/023* (2013.01); *H01H 9/043* (2013.01); *H01H 50/026* (2013.01);
(Continued)

(58) Field of Classification Search
CPC .. H01H 9/043; H01H 9/047; H01H 2009/048; H01H 50/023; H01H 50/12;
(Continued)

(56) References Cited

U.S. PATENT DOCUMENTS 2,524,874 A * 10/1950 Bean ..... H01H 50/023 200/1 A
3,215,800 A * 11/1965 Hurter ..... H01H 11/0012 200/280

(Continued)

FOREIGN PATENT DOCUMENTS

CN 102473552 A 5/2012
JP H0234056 U 3/1990

(Continued)

OTHER PUBLICATIONS

State Intellectual Property Office of the People's Republic of China, Office Action and Search Report Issued in Application No. 201704583.6, dated May 8, 2018, 11 pages. (Submitted with Partial Translation).

(Continued)

*Primary Examiner* — Shawki S Ismail
*Assistant Examiner* — Lisa N Homza
(74) *Attorney, Agent, or Firm* — McCoy Russell LLP

(57) ABSTRACT

An electromagnetic relay according to an aspect of the present disclosure includes a housing including a base part on which an electromagnetic relay main body is mounted, and a cover part covering the electromagnetic relay main body, in which the housing is in a sealed state when a pressure inside the housing is equal to or lower than a predetermined pressure, in which when the pressure inside the housing is equal to or lower than the predetermined pressure, the cover part and the base part are butted against each other, and the electromagnetic relay includes a connection passage connecting an abutment part between the cover part and the base part to outside of the electromagnetic relay.

4 Claims, 8 Drawing Sheets

(51) Int. Cl.

| | |
|---|---|
| ***H01H 9/04*** | (2006.01) |
| ***H01H 50/12*** | (2006.01) |
| ***H01H 51/28*** | (2006.01) |
| *H01H 50/04* | (2006.01) |
| *H01H 51/22* | (2006.01) |
| *H01H 33/662* | (2006.01) |

(52) U.S. Cl.
CPC ..... *H01H 50/12* (2013.01); *H01H 51/281* (2013.01); *H01H 51/282* (2013.01); *H01H 50/041* (2013.01); *H01H 51/229* (2013.01); *H01H 2033/6623* (2013.01)

(58) Field of Classification Search
CPC .... H01H 50/026; H01H 50/041; H01H 50/58; H01H 51/281; H01H 51/282
USPC ..... 335/202
See application file for complete search history.

(56) References Cited

U.S. PATENT DOCUMENTS 3,296,567 A * 1/1967 Conner ..... H01H 50/545 200/50.32
3,339,161 A * 8/1967 Conner ..... H01H 50/22 200/243
3,382,469 A * 5/1968 Conner ..... H01H 50/22 335/131
3,775,710 A * 11/1973 Cook ..... H01H 43/28 335/61
4,085,393 A * 4/1978 Grenier ..... H01H 71/2472 335/202
4,568,207 A * 2/1986 Hara ..... B41J 2/275 101/93.05
4,731,597 A * 3/1988 Hinrichs ..... H01H 50/026 335/128
5,018,050 A * 5/1991 Maenishi ..... H05K 5/0247 335/202
5,668,515 A * 9/1997 Ariyoshi ..... H01F 6/02 324/318
6,188,302 B1 * 2/2001 Conway ..... H01H 71/465 335/172
6,337,614 B1 * 1/2002 Tsutsui ..... H01H 50/02 335/160
6,359,537 B1 * 3/2002 Ichikawa ..... H01H 49/00 335/78
7,579,934 B2 * 8/2009 Muller ..... H01H 50/041 335/106
8,093,974 B2 * 1/2012 Nagura ..... H01H 9/047 335/201
8,471,656 B2 * 6/2013 Horii ..... H01H 50/043 335/78
8,941,453 B2 * 1/2015 Yano ..... H01H 1/66 335/131
D842,256 S * 3/2019 Tanaka ..... D13/159
2002/0036556 A1 * 3/2002 Matsuda ..... H01H 50/12 335/78
2005/0072591 A1 * 4/2005 Hayase ..... H01H 50/14 174/667
2009/0102586 A1 * 4/2009 Bush ..... H01H 49/00 335/153
2009/0237191 A1 * 9/2009 Yano ..... H01H 9/443 335/202
2009/0243768 A1 * 10/2009 Sato ..... H01C 7/102 335/7
2009/0322453 A1 * 12/2009 Kawaguchi ..... H01F 7/1615 335/81
2012/0139672 A1 6/2012 Takaya et al.
2015/0024941 A1 * 1/2015 Tamura ..... H01F 6/00 505/211

FOREIGN PATENT DOCUMENTS

JP 2006331782 A 12/2006
JP 2009283255 A 12/2009
JP 2011003287 A 1/2011

OTHER PUBLICATIONS

Japan Patent Office, Office Action Issued in Application No. 2017-045836, dated May 8, 2018, 11 pages.
State Intellectual Property Office of the People's Republic of China, Office Action and Search Report Issued in Application No. 201810016389.7, dated Mar. 12, 2019, 8 pages. (Submitted with Partial Translation).

* cited by examiner

ELECTROMAGNETIC RELAY

INCORPORATION BY REFERENCE

This application is based upon and claims the benefit of priority from Japanese patent application No. 2017-045836, filed on Mar. 10, 2017, the disclosure of which is incorporated herein in its entirety by reference for all purposes.

BACKGROUND

The present disclosure relates to an electromagnetic relay including a housing including a base part on which an electromagnetic relay main body is mounted, and a cover part covering the electromagnetic relay main body, in which the housing is in a sealed state when a pressure inside the housing is equal to or lower than a predetermined pressure.

An ordinary electromagnetic relay includes a housing including a base part on which an electromagnetic relay main body is mounted, and a cover part covering the electromagnetic relay main body. Further, the housing is put in a sealed state by using a sealing resin in order to prevent the intrusion of foreign substances and the like into the housing.

Such an electromagnetic relay undergoes, for example, a reflow heating process in order to solder external terminals of an electromagnetic relay main body to a circuit board. However, since the housing is in a sealed stated as described above, the pressure inside the housing rises during the reflow heating process, thus raising a possibility that a defect such as a deformation of the housing could occur.

Therefore, for example, Japanese Unexamined Patent Application Publication No. 2011-3287 discloses an electromagnetic relay including a through hole formed in a cover part, and an internal pressure adjustment lid that is disposed in the cover part and covers the through hole, in which when the pressure inside the housing rises, the internal pressure adjustment lid deforms and thereby lets a gas contained in the housing escape through the through hole.

SUMMARY

The present inventors have found the following problem. In the electromagnetic relay disclosed in Japanese Unexamined Patent Application Publication No. 2011-3287, it is necessary to provide the internal pressure adjustment lid in the cover part to let the gas contained in the housing escape. Therefore, in the electromagnetic relay disclosed in Japanese Unexamined Patent Application Publication No. 2011-3287, the number of components is large and the manufacturing process is complicated. As a result, the cost for manufacturing the electromagnetic relay is high.

The present disclosure has been made in the above-described background to provide an electromagnetic relay capable of suppressing a rise in a pressure inside a housing during a reflow heating process while reducing a cost for manufacturing the electromagnetic relay.

A first exemplary aspect is an electromagnetic relay including a housing including a base part on which an electromagnetic relay main body is mounted, and a cover part covering the electromagnetic relay main body, in which the housing is in a sealed state when a pressure inside the housing is equal to or lower than a predetermined pressure, in which when the pressure inside the housing is equal to or lower than the predetermined pressure, the cover part and the base part are butted against each other, and the electromagnetic relay includes a connection passage connecting an abutment part between the cover part and the base part to outside of the electromagnetic relay.

By the above-described configuration, there is no need to provide an internal pressure adjustment lid, which is necessary in an ordinary electromagnetic relay, thus making it possible to reduce the number of components and simplify the manufacturing process. As a result, it is possible to suppress a rise in a pressure in the internal space of the housing during a reflow heating process while reducing a cost for manufacturing the electromagnetic relay.

In the above-described electromagnetic relay, the abutment part is preferably a valve mechanism configured to cut off the connection between the inside of the housing and the connection passage when the pressure inside the housing is equal to or lower than the predetermined pressure, and separate when the pressure inside the housing is higher than the predetermined pressure and thereby connect the inside of the housing with the connection passage.

In the above-described electromagnetic relay, a projection formed in the cover part is preferably engaged with a recess formed in the base part, and the abutment part is preferably an abutment surface composed of a top surface of the projection in the cover part and a bottom surface of the recess in the base part.

In the above-described electromagnetic relay, a recess formed in the cover part is preferably engaged with a projection formed in the base part, and the abutment part is preferably an abutment surface composed of a bottom surface of the recess in the cover part and a top surface of the projection in the base part.

In the above-described electromagnetic relay, the connection passage is preferably formed on a side wall of the cover part.

In the above-described electromagnetic relay, the connection passage is preferably formed in the base part.

In the above-described electromagnetic relay, the connection passage preferably extends in a direction in which an external terminal of the electromagnetic relay main body extends.

In the above-described electromagnetic relay, a heat-radiation part is preferably formed in the housing.

In the above-described electromagnetic relay, the heat-radiation part is preferably disposed near a movable contact of the electromagnetic relay main body with respect to an electromagnet of the electromagnetic relay main body.

In the above-described electromagnetic relay, the heat-radiation part is preferably disposed near the connection passage.

According to the present disclosure, it is possible to suppress a rise in a pressure inside the housing during a reflow heating process while reducing a cost for manufacturing the electromagnetic relay.

The above and other objects, features and advantages of the present invention will become more fully understood from the detailed description given hereinbelow and the accompanying drawings which are given by way of illustration only, and thus are not to be considered as limiting the present invention.

DESCRIPTION OF EMBODIMENTS

Specific embodiments to which the present disclosure is applied are explained hereinafter in detail with reference to the drawings. However, the present disclosure is not limited to the below-shown embodiments. Further, the following descriptions and the drawings are simplified as appropriate for clarifying the explanation.

Figure 1:
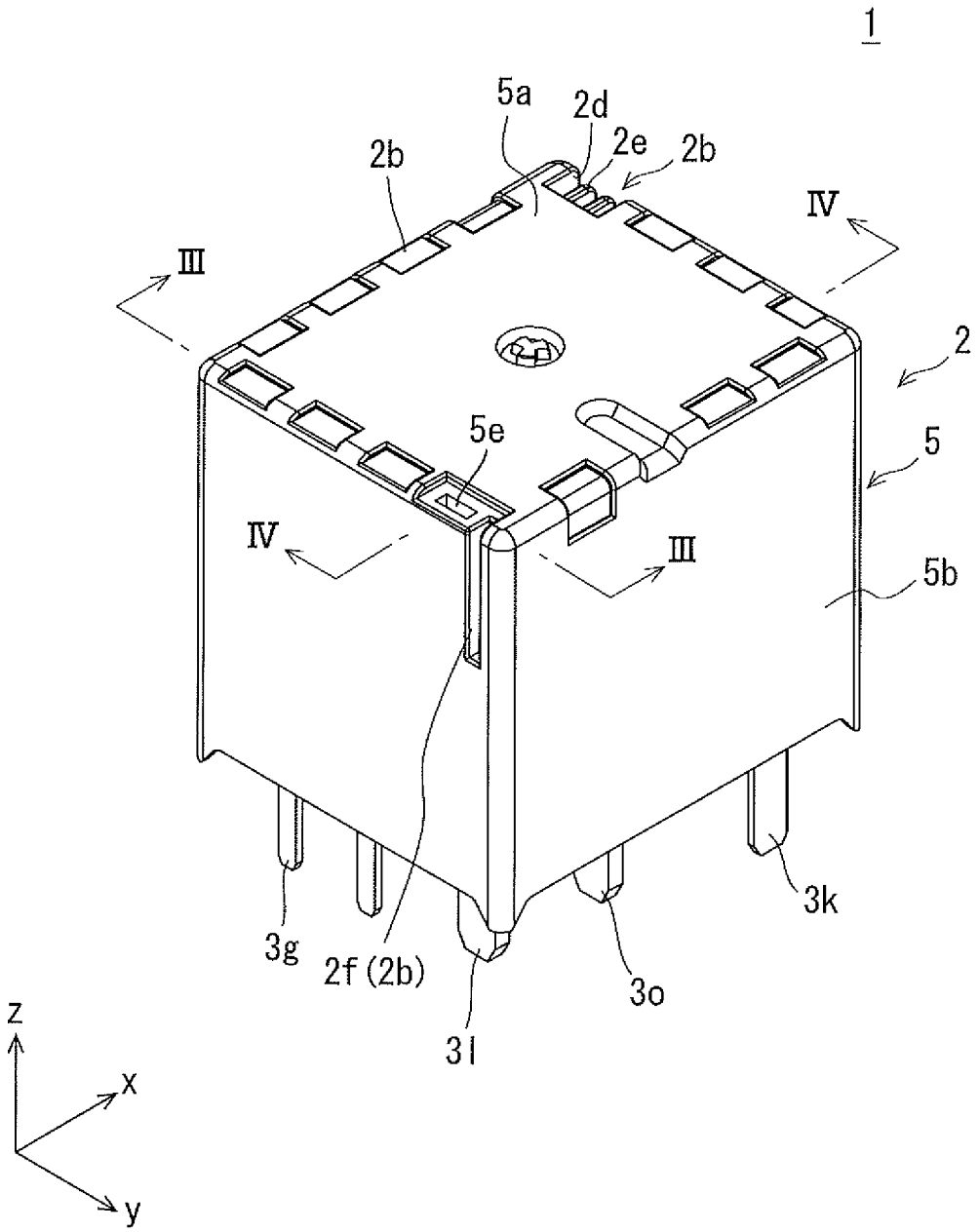
FIG. 1 is a perspective view schematically showing an electromagnetic relay according to an embodiment.
Figure 2:
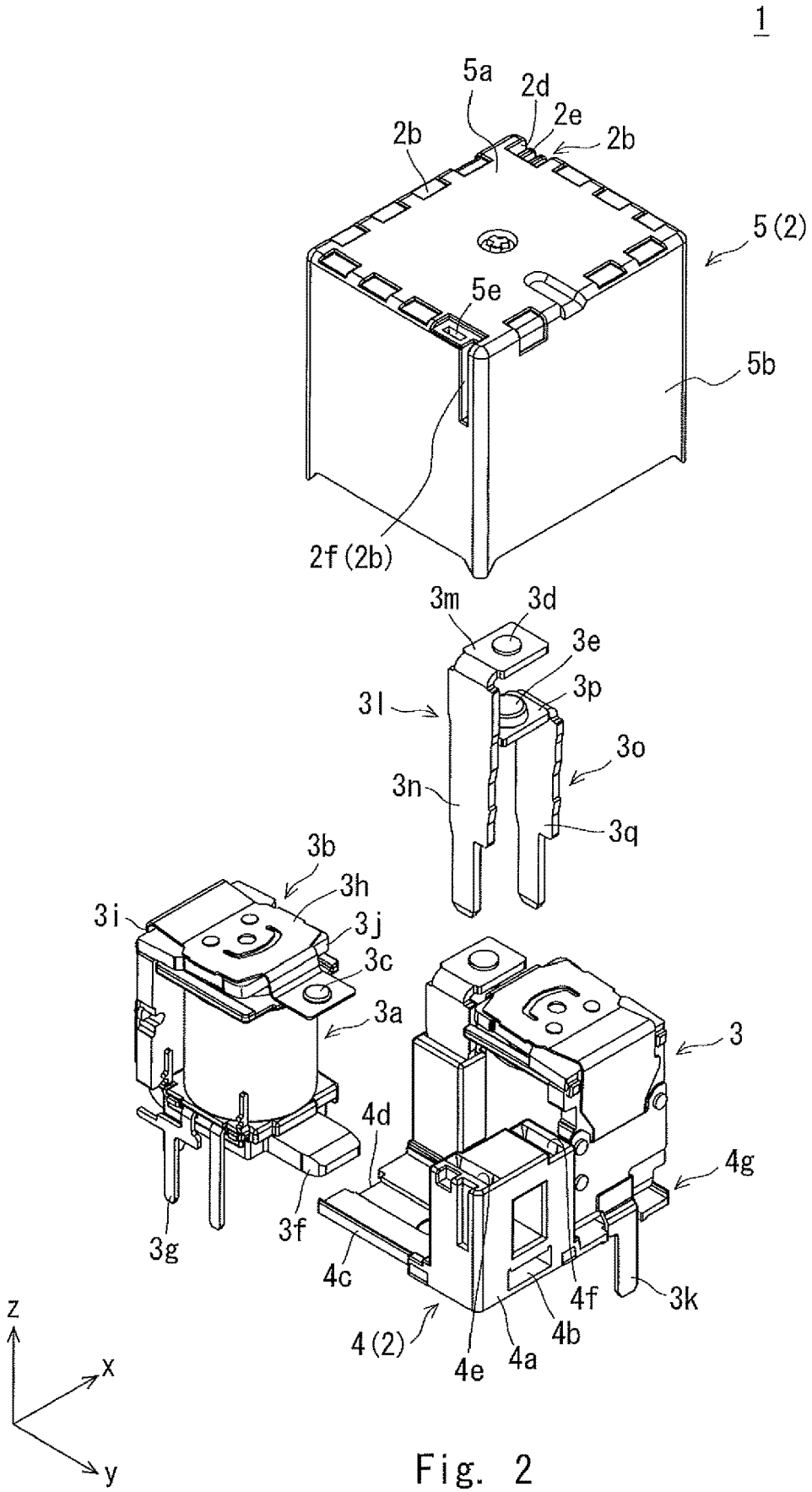
FIG. 2 is an exploded view schematically showing the electromagnetic relay according to the embodiment.
Figure 3:
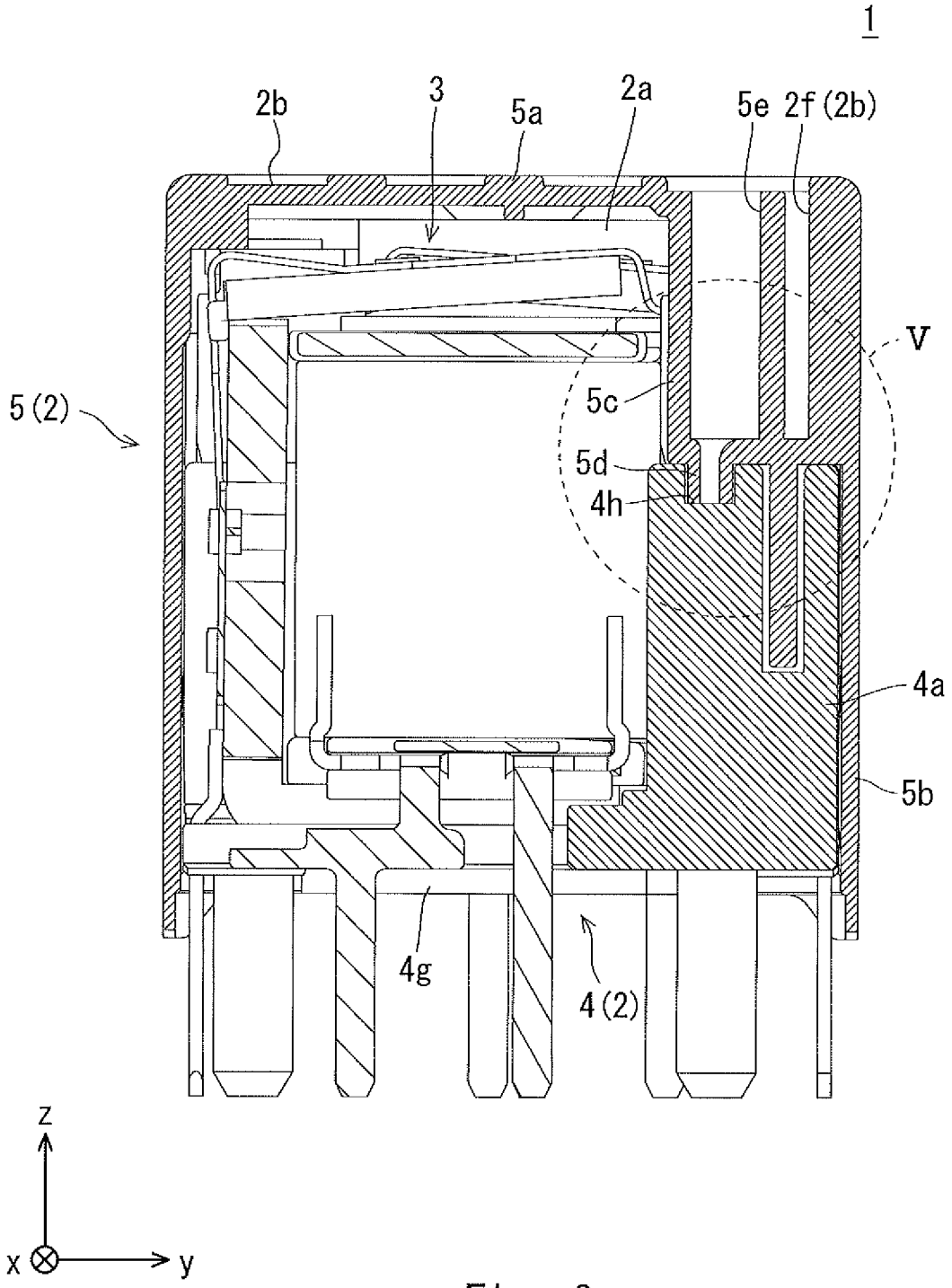
FIG. 3 is a cross section taken along a line III-III in FIG. 1.
Figure 4:
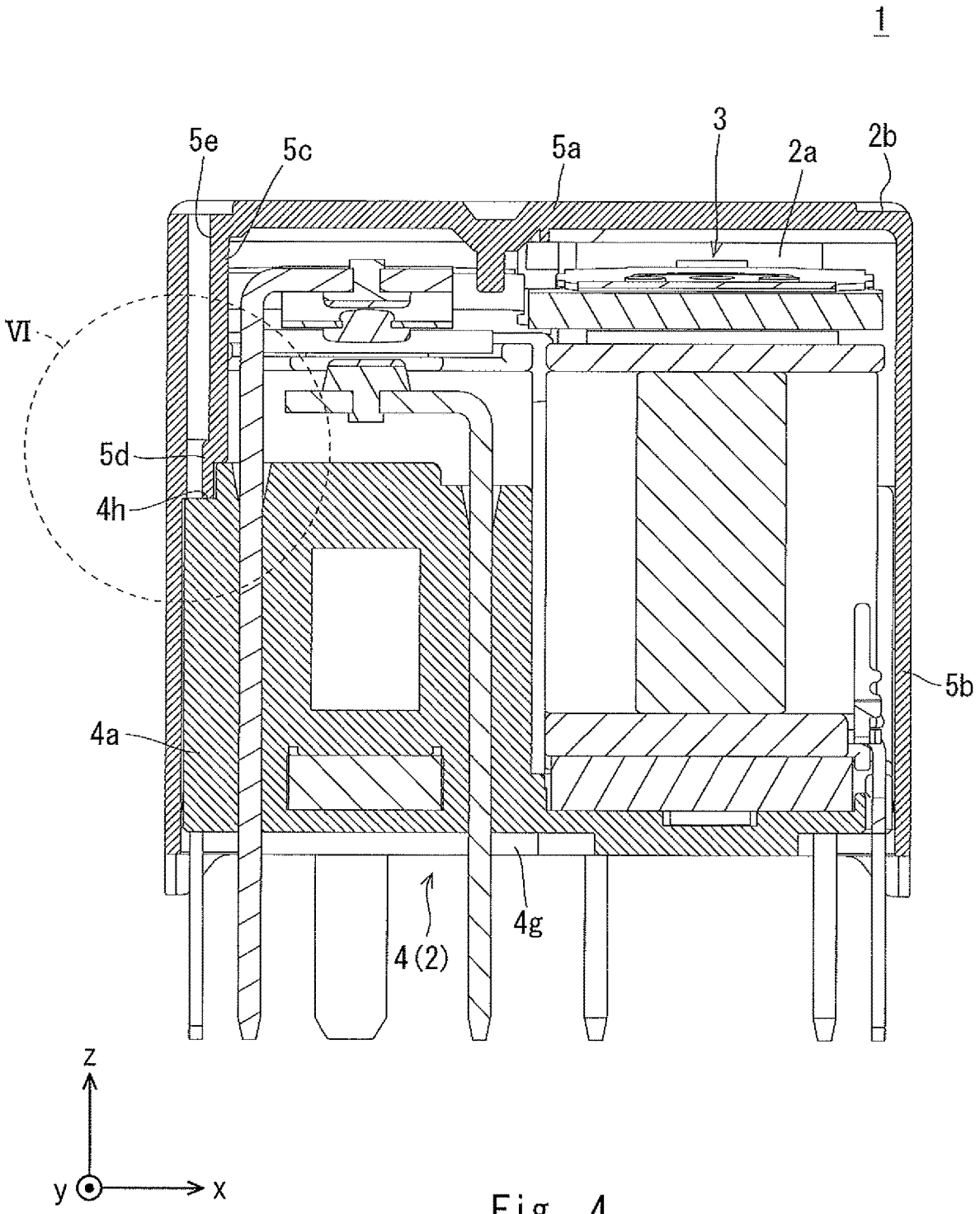
FIG. 4 is a cross section taken along a line IV-IV in FIG. 1.

Firstly, a fundamental configuration of an electromagnetic relay according to an embodiment is briefly explained. FIG. 1 is a perspective view schematically showing an electromagnetic relay according to this embodiment. FIG. 2 is an exploded view schematically showing the electromagnetic relay according to this embodiment. FIG. 3 is a cross section taken along a line III-III in FIG. 1. FIG. 4 is a cross section taken along a line IV-IV in FIG. 1.

Note that FIGS. 3 and 4 show a state in which a pressure inside a housing of the electromagnetic relay is equal to or lower than a predetermined pressure. Note that the following explanation is given by using a three-dimensional coordinate system (an xyz-coordinate system) shown in FIG. 1 and the like for clarifying the explanation.

As shown in FIGS. 1 and 2, the electromagnetic relay 1 includes a housing 2 and an electromagnetic relay main body 3. The housing 2 includes a base part 4 on which the electromagnetic relay main body 3 is mounted and a cover part 5 covering the electromagnetic relay main body 3. The above-described housing 2 is formed of an insulating resin material and is put in a sealed state by a sealing resin. Note that specific forms of the base part 4 and cover part 5 will be described later.

As shown in FIG. 2, for example, two electromagnetic relay main bodies 3 are arranged side by side in an x-axis direction and mounted on a surface on a positive side in a z-axis direction (hereinafter expressed as a z-axis positive side) of the base part 4. Further, the two electromagnetic relay main bodies 3 are arranged in a point-symmetric manner around a central axis extending in the z-axis direction in the electromagnetic relay 1. However, the number and arrangement of electromagnetic relay main bodies 3 mounted in the electromagnetic relay 1 are not limited to any particular number and arrangement.

Note that the following explanation of the electromagnetic relay main bodies 3 is given by using the electromagnetic relay main body 3 disposed in the farthest place on the x-axis negative side as an example. The electromagnetic relay main body 3 moves a movable contact 3*c* disposed at an end on the y-axis positive side in a leaf spring 3*b* in the z-axis direction by a magnetic attractive force of an electromagnet 3*a* and thereby changes its electric connection to a first fixed contact 3*d* or a second fixed contact 3*e*, which are placed over or under the movable contact 3*c* in the z-axis direction.

Similarly to an ordinary electromagnet, the electromagnet 3*a* includes an iron core, a coil, a yoke, and so on. Further, a protrusion (e.g., the yoke) 3*f* protruding in the y-axis positive direction of the electromagnet 3*a* is engaged in a first through hole 4*b* of a protruding part 4*a* protruding in the z-axis positive direction in the base part 4. Further, a first terminal (an external terminal) 3*g* through which electric power is externally supplied to the coil of the electromagnet 3*a* protrudes in the z-axis negative direction from a first cut-out part 4*c* formed on a fringe of the base part 4.

The leaf spring 3*b* includes a part 3*h* extending roughly in the y-axis direction, and a part 3*i* extending in the z-axis negative direction from an end on the y-axis negative side of the part 3*h*. Further, an end on the y-axis positive side in the part 3*h* extending roughly in the y-axis direction, in which the movable contact 3*c* is disposed, is disposed between the first and second fixed contacts 3*d* and 3*e*. Further, a plate-like armature 3*j* made of a magnetic material is provided in a place that is opposed to the iron core of the electromagnet 3*a* in the z-axis direction on a surface on the z-axis negative side of the part 3*h* extending roughly in the y-axis direction.

The part 3*i* extending in the z-axis negative direction in the leaf spring 3*b* is fixed to the electromagnet 3*a* (e.g., the yoke) and a second terminal (an external terminal) 3*k* is connected to an end on the z-axis negative side of the part 3*i*. The second terminal 3*k* protrudes in the z-axis negative direction from a second cut-out part 4*d* formed in a fringe of the base part 4.

In this way, the iron core of the electromagnet 3*a* is magnetically joined to the armature 3*j* by a magnetic force of the electromagnet 3*a*. Further, when the magnetic force of the electromagnet 3*a* is turned off, the armature 3*j* moves away from the iron core of the electromagnet 3*a* and the movable contact 3*c* is lifted up toward the z-axis positive side by a restoring force of the leaf spring 3*b*.

The first fixed contact 3*d* is provided in a third terminal (an external terminal) 3*l*. The third terminal 3*l* includes a part 3*m* that is provided with the first contact 3*d* and extends in the x-axis direction, and a part 3*n* that extends in the z-axis negative direction from an end on the x-axis negative side of the part 3*m*.

The part 3*n* extending in the z-axis negative direction of the third terminal 3*l* is engaged in a second through hole 4*e* of the protruding part 4*a* in the base part 4 and its end on the z-axis negative side protrudes in the z-axis negative direction from the base part 4.

The second fixed contact 3*e* is provided in a fourth terminal (an external terminal) 3*o*. The fourth terminal 3*o* includes a part 3*p* that is provided with the second fixed contact 3*e* and extends in the x-axis direction, and a part 3*q* that extends in the z-axis negative direction from an end on the x-axis positive side of the part 3*p*.

The part 3*q* extending in the z-axis negative direction of the fourth terminal 3*o* is engaged in a third through hole 4*f* of the protruding part 4*a* in the base part 4 and its end on the z-axis negative side protrudes in the z-axis negative direction from the base part 4.

Figure 5:
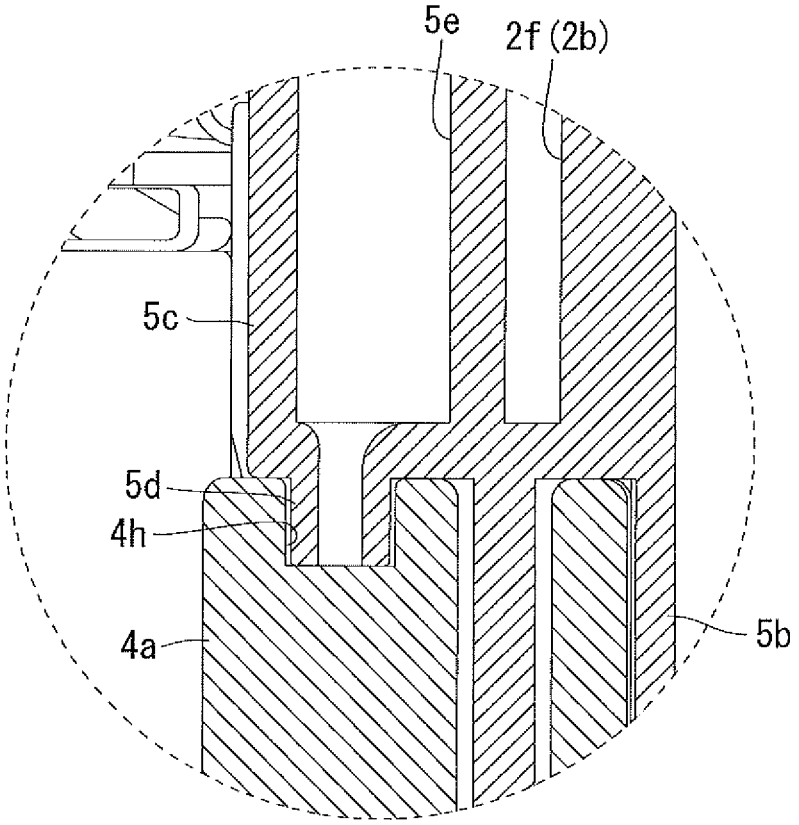
FIG. 5 is an enlarged view showing a V-part in FIG. 3.
Figure 6:
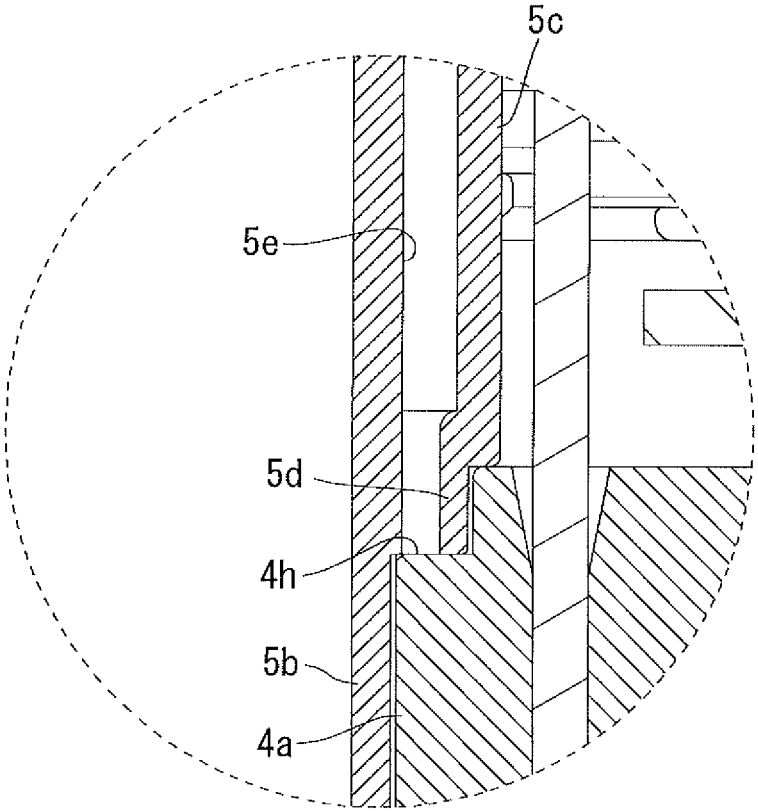
FIG. 6 is an enlarged view showing a VI-part in FIG. 4.

Next, structures of the base part 4 and the cover part 5 of the electromagnetic relay 1 according to this embodiment are explained. Here, FIG. 5 is an enlarged view showing a V-part in FIG. 3 and FIG. 6 is an enlarged view showing a VI-part in FIG. 4.

As shown in FIGS. 2 to 4, the base part 4 includes a plate part 4*g* having a roughly rectangular shape as viewed in the z-axis direction, and protruding parts 4*a* protruding in the z-axis positive direction from the aforementioned plate part 4*g*. The above-described first and second cut-out parts 4*c* and 4*d* are formed in the plate part 4*g*. For example, protruding parts 4*a* are disposed at opposed corners in the plate part 4*g*. However, the arrangement and number of protruding parts 4*a* can be changed as appropriate according to the arrangement and number of pairs of the third terminal 3*l* and the fourth terminal 3*o*.

In the protruding part 4*a*, the above-described first through hole 4*b* is formed so as to extend in the y-axis direction. Further, the second and third through holes 4*e* and 4*f* extending in the z-axis direction are formed with an interval therebetween in the x-axis direction in the protruding part 4*a*.

As shown in FIGS. 2 to 4, the cover part 5 includes a top plate 5*a* and a side wall 5*b* extending in the z-axis negative direction from a fringe of the top plate 5*a*. Further, a space for accommodating the electromagnetic relay main body 3 (i.e., an internal space 2*a* of the housing 2) is formed inside the cover part 5.

Further, a gap between the plate part 4*g* of the base part 4 and the side wall 5*b* of the cover part 5 is sealed by a sealing resin in a state in which the base part 4 on which the electromagnetic relay main body 3 is mounted is covered by the cover part 5 so that the internal space 2*a* of the housing 2 is brought into a roughly sealed state.

As shown in FIGS. 3 and 4, a protruding part 5*c* protruding toward the inside of the cover part 5 is formed in the side wall 5*b*. The protruding part 5*c* extends in the z-axis negative direction from the top plate 5*a* and is disposed on the z-axis positive side with respect to the protruding part 4*a* of the base part 4.

When the pressure in the internal space 2*a* of the housing 2 is equal to or lower than a predetermined pressure, the surface on the z-axis negative side in the protruding part 5*c* is butted against and is in contact with the surface on the z-axis positive side of the protruding part 4*a* in the base part 4 as shown in FIGS. 5 and 6.

That is, when the pressure in the internal space 2*a* of the housing 2 is equal to or lower than the predetermined pressure, the butted surfaces, i.e., the surface on the z-axis positive side of the protruding part 4*a* in the base part 4 and the surface on the z-axis negative side in the protruding part 5*c* in the cover part 5 form an abutment part.

Note that as shown in FIGS. 5 and 6, in this embodiment, a recess 4*h* recessed from the protruding part 4*a* of the base part 4 in the z-axis negative direction is engaged with a projection 5*d* projecting from the protruding part 5*c* of the cover part 5 in the z-axis negative direction. Further, at least the butted surfaces, i.e., the surface on the z-axis negative side of the recess 4*h* (i.e., the bottom surface of the recess 4*h*) and the surface on the z-axis negative side of the projection 5*d* (i.e., the top surface of the projection 5*d*) form the above-described abutment part.

The recess 4*h* of the base part 4 is, for example, a cut-out part formed in the surface on the outer peripheral side of the electromagnetic relay 1 in the protruding part 4*a* and extends in the z-axis negative direction from the surface on the z-axis positive side of the protruding part 4*a*. The projection 5*d* of the cover part 5 is formed in the protruding part 5*c* of the cover part 5 so as to conform to the recess 4*h* of the base part 4. Note that the projection 5*d* of the cover part 5 is engaged with the recess 4*h* of the base part 4 in such a manner that it allows the cover part 5 to deform when the pressure in the internal space 2*a* of the housing 2 rises.

However, the shapes of the recess 4*h* of the base part 4 and the projection 5*d* of the cover part 5 are not limited to the above-described shapes. That is, they may have any engaging structure in which the abutment part of the base part 4 and the cover part 5 can be formed and the cover part 5 is allowed to deform when the pressure in the internal space 2*a* of the housing 2 rises.

As shown in FIGS. 3 and 4, a connection passage 5*e* that extends from the surface on the z-axis negative side of the projection 5*d* and reaches the top plate 5*a* is formed in the protruding part 5*c* of the cover part 5. For example, the connection passage 5*e* extends in the z-axis direction, penetrates the protruding part 5*c* of the cover part 5, and reaches outside of the electromagnetic relay 1.

Therefore, when the pressure in the internal space 2*a* of the housing 2 is equal to or lower than the predetermined pressure, the connection passage 5*e* connects the abutment part between the surface on the z-axis negative side of the recess 4*h* in the base part 4 and the surface on the z-axis negative side of the projection 5*d* in the cover part 5 to outside of the electromagnetic relay 1.

In the housing 2 having the above-described configuration, when the pressure in the internal space 2*a* of the housing 2 is equal to or lower than the predetermined pressure, the surface on the z-axis negative side of the recess 4*h* in the base part 4 is in contact with the surface on the z-axis negative side of the projection 5*d* in the cover part 5. Therefore, the connection between the internal space 2*a* of the housing 2 and the connection passage 5*e* is cut off and hence the internal space 2*a* of the housing 2 is maintained in the sealed state.

On the other hand, when the pressure in the internal space 2*a* of the housing 2 rises beyond the predetermined pressure during a soldering process in which the first, second, third and fourth terminals 3*g*, 3*k*, 3*l* and 3*o* of the electromagnetic relay 1 are connected (e.g., soldered) to a circuit board through a reflow heating process, a gas contained in the internal space 2*a* of the housing 2 escapes through the connection passage 5*e*.

Figure 7:
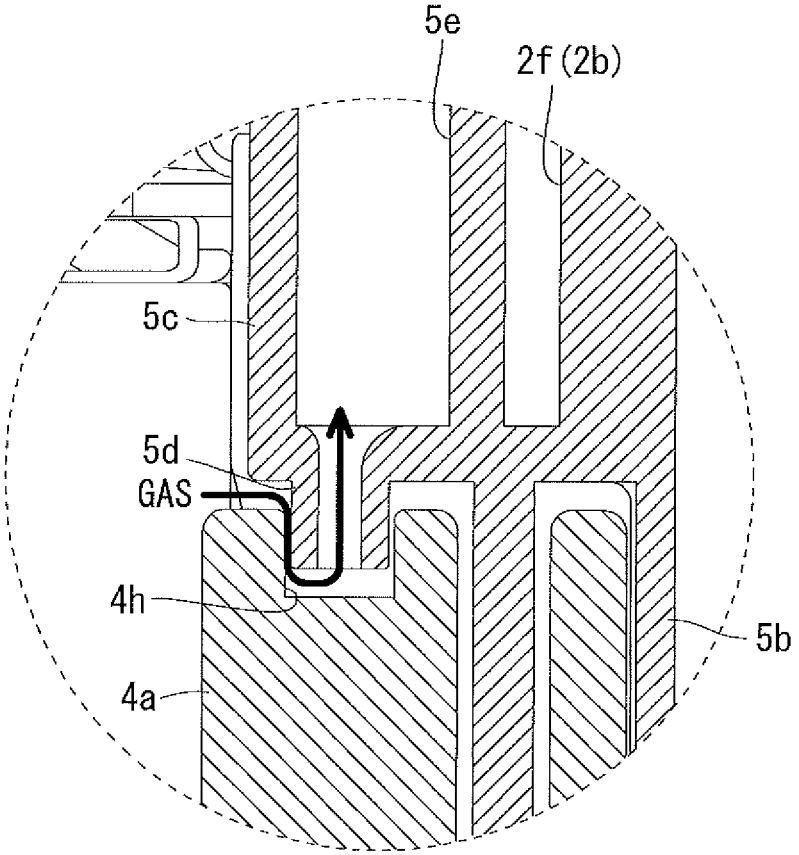
FIG. 7 is an enlarged view corresponding to FIG. 5, showing the housing in a state where in a pressure an internal space of the housing is higher than a predetermined pressure.
Figure 8:
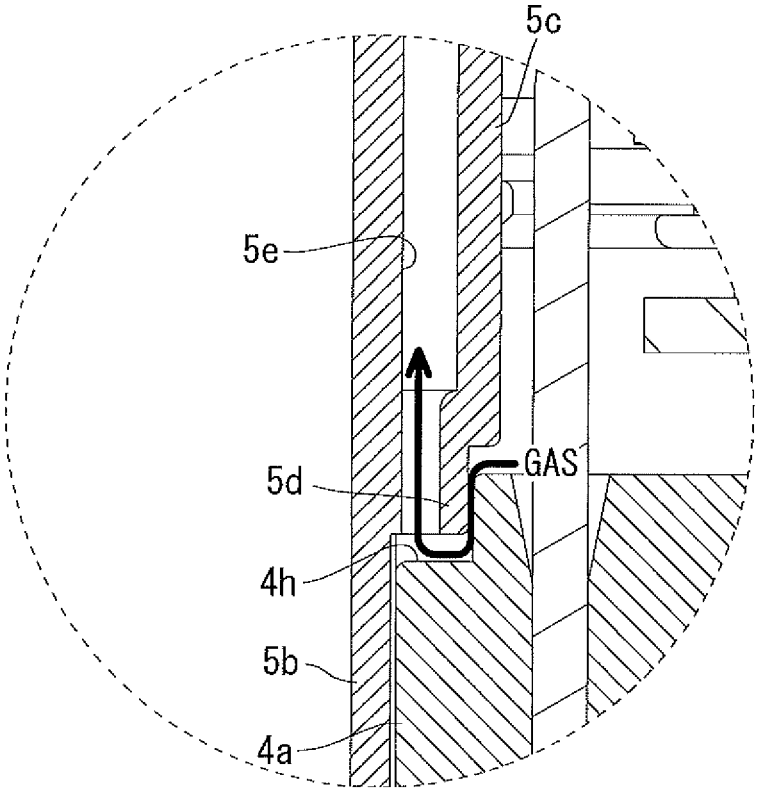
FIG. 8 is an enlarged view corresponding to FIG. 6, showing the housing in a state where a pressure in an internal space of the housing is higher than a predetermined pressure.

Here, FIG. 7 is an enlarged view corresponding to FIG. 5, showing the housing in a state where the pressure in the internal space of the housing rises beyond the predetermined pressure. FIG. 8 is an enlarged view corresponding to FIG. 6, showing the housing in a state where the pressure in the internal space of the housing rises beyond the predetermined pressure. However, in FIGS. 7 and 8, the gap between the base part and the cover part is shown in an exaggerated manner and the deformation of the cover part is shown in a simplified manner.

When the pressure in the internal space 2*a* of the housing 2 rises beyond the predetermined pressure, the cover part 5 deforms so that it expands outwardly because the internal space 2*a* of the housing 2 is roughly in a sealed state. As a result, as shown in FIGS. 7 and 8, the surface on the z-axis positive side of the protruding part 4*a* in the base part 4 and the surface on the z-axis negative side in the protruding part 5*c* in the cover part 5 get away from each other. Therefore, the abutment part composed of the surface on the z-axis negative side of the recess 4*h* in the base part 4 and the surface on the z-axis negative side in the projection 5*d* in the cover part 5 is separated so that these surfaces relatively move away from each other. Consequently, the internal space 2*a* of the housing 2 is connected to the connection passage 5*e* and hence a gas contained in the internal space 2*a* of the housing 2 escapes to outside of the electromagnetic relay 1 through the connection passage 5*e*.

As described above, the electromagnetic relay 1 according to this embodiment makes the abutment part between the surface on the z-axis positive side of the protruding part 4*a* in the base part 4 and the surface on the z-axis negative side of the protruding part 5*c* in the cover part 5 function as a valve mechanism. Therefore, when the pressure in the internal space 2*a* of the housing 2 rises beyond the predetermined pressure, the internal space 2*a* of the housing 2 is connected to the connection passage 5*e*, thus allowing a gas contained in the internal space 2*a* of the housing 2 to escape to outside of the electromagnetic relay 1 through the connection passage 5*e*. Further, these base part 4 and the cover part 5 can be easily formed by, for example, resin molding.

Therefore, in the electromagnetic relay 1 according to this embodiment, there is no need to provide an internal pressure adjustment lid, which is necessary in an ordinary electromagnetic relay, thus making it possible to reduce the number of components and simplify the manufacturing process. As a result, it is possible to suppress a rise in a pressure in the internal space 2*a* of the housing 2 during a reflow heating process while reducing a cost for manufacturing the electromagnetic relay 1.

In addition, the connection passage 5*e* is formed in the protruding part 5*c* of the side wall 5*b* in the cover part 5 in this embodiment. That is, since the connection passage 5*e* is formed in a part of the side wall 5*b* having a large wall-thickness, it is possible to prevent the strength of the side wall 5*b* from being reduced. Note that by disposing the connection passage 5*e* in a dead space in the internal space 2*a* of the housing 2, it is possible to prevent the size of the electromagnetic relay 1 from being increased.

Further, in this embodiment, since the recess 4*h* of the base part 4 is engaged with the projection 5*d* of the cover part 5, the passage from the abutment part between the surface on the z-axis negative side of the recess 4*h* in the base part 4 and the surface on the z-axis negative side of the projection 5*d* in the cover part 5 to the internal space 2*a* of the housing 2 has a crank shape. In this way, it means that the following redundant design is made for the housing 2. That is, even if the abutment part between the surface on the z-axis negative side of the recess 4*h* in the base part 4 and the surface on the z-axis negative side of the projection 5*d* in the cover part 5 separates (i.e., the surfaces get away from each other) during a reflow heating process in a state where foreign substances are accumulated in the abutment part through the connection passage 5*e*, there is a place in the passage in which the foreign substances need to move in a direction opposite to the direction of the gravitational force when the direction of the gravitational force defined as the z-axis negative direction. Therefore, the foreign substances hardly flow backward (i.e., hardly flow from outside of the electromagnetic relay 1 to inside thereof) and hardly reach the internal space 2*a* of the housing 2. Accordingly, it is possible to prevent faulty connection between contacts more reliably.

Note that as shown in FIG. 1 and the like, a heat-radiation part 2*b* is preferably formed in the housing 2. The heat-radiation part 2*b* may have any shape by which the surface area of the housing 2 can be increased. For example, the heat-radiation part 2*b* may be formed in a recessed shape and cooling fins 2*e* may be formed in the recessed part 2*d*. In this way, it is possible to dissipate heat generated in the electromagnetic relay main body 3 through the housing 2.

Note that the heat-radiation part 2*b* is preferably disposed near the first and second fixed contacts 3*d* and 3*e*. For example, the heat-radiation part 2*b* may be disposed at a corner of the cover part 5. In this embodiment, since the protruding part 5*c* is formed at the corner of the cover part 5, it is possible to form a large heat-radiation part 2*b* using the large wall-thickness of the protruding part 5*c*. In this way, it is possible to excellently dissipate heat caused by electric connection between the movable contact 3*c* and the first or second fixed contact 3*d* or 3*e* through the housing 2.

Further, in this embodiment, a recess 2*f* located near the connection passage 5*e* disposed in the protruding part 5*c* is also formed as a heat-radiation part 2*b*. In this way, it is possible to reduce the wall-thickness of the protruding part 5*c* around the connection passage 5*e*. As a result, the cover part 5 can easily deform when the pressure in the internal space 2*a* of the housing 2 rises beyond the predetermined pressure. Therefore, it is possible to obtain synergistic effects, i.e., obtain both an improvement in the valve function of letting a gas contained in the internal space 2*a* escape to outside of the electromagnetic relay 1 and an improvement in the heat-radiation property.

Incidentally, the heat-radiation part 2*b* is preferably disposed in a place other than the central area of the top plate 5*a* in the cover part 5. In this way, it is possible to convey the electromagnetic relay 1 while sucking up the top plate 5*a* of the cover part 5 by a sucking mechanism.

The present disclosure is not limited to the above-described embodiments and may be changed as appropriate without departing from the spirit of the present disclosure.

For example, the configuration of the electromagnetic relay main body 3 is not limited to the above-described configuration. That is, the configuration of the electromagnetic relay main body 3 is not limited to any particular configuration.

For example, in the above-described embodiment, the abutment part is formed by the surface on the z-axis positive side of the protruding part 4*a* in the base part 4 and the surface on the z-axis negative side in the protruding part 5*c* in the cover part 5. However, the abutment part may be formed by any part in which the base part 4 and the cover part 5 can be butted against each other. Further, the abutment part may be formed by an abutment surface formed by a peripheral area of a recess formed in one of the base part 4 and the cover part 5 and a peripheral area of a projection formed in the other of the base part 4 and the cover part 5.

For example, although the recess 4*h* of the base part 4 is engaged with the projection 5*d* of the cover part 5 in the above-described embodiment, a projection formed in the base part 4 may be engaged with a recess formed in the cover part 5.

For example, although the connection passage 5*e* is formed in the cover part 5 in the above-described embodiment, it may be formed in the base part 4. Further, the connection passage 5*e* does not necessarily have to extend in the z-axis direction. That is, the only requirement for the connection passage 5*e* is that it should be able to connect the abutment part between the base part 4 and the cover part 5 to outside of the electromagnetic relay 1.

For example, the heat-radiation part 2*b* is preferably formed in at least one of the base part 4 and the cover part 5.

From the invention thus described, it will be obvious that the embodiments of the invention may be varied in many ways. Such variations are not to be regarded as a departure from the spirit and scope of the invention, and all such modifications as would be obvious to one skilled in the art are intended for inclusion within the scope of the following claims.

What is claimed is:

1. An electromagnetic relay comprising a housing comprising a base part on which an electromagnetic relay main body is mounted, and a cover part covering the electromagnetic relay main body, in which the housing is in a sealed state when a pressure inside the housing is equal to or lower than a predetermined pressure, wherein, when the pressure inside the housing is equal to or lower than the predetermined pressure, the cover part and the base part are butted against each other, and the electromagnetic relay comprises a connection passage connecting an abutment part between the cover part and the base part to outside of the electromagnetic relay, the electromagnetic relay further comprising a projection protruding from a protruding part, the protruding part protruding toward an inside of the cover part and toward the base part, wherein the projection is engaged with a recess formed at a second protruding part where an external terminal of the electromagnetic relay main body is fixed in the base part, wherein the abutment part is an abutment surface composed of a top surface of a second projection of the cover part and a bottom surface of a second recess of the base part, wherein the connection passage is formed in such a way that the connection passage penetrates the protruding part in a direction in which the external terminal of the electromagnetic relay main body extends, and wherein a heat-radiation part is formed in the housing.

2. The electromagnetic relay according to claim 1, wherein the abutment part is a valve mechanism configured to cut off a connection between an inside of the housing and the connection passage when the pressure inside the housing is equal to or lower than the predetermined pressure, and separate when the pressure inside the housing is higher than the predetermined pressure and thereby connect the inside of the housing with the connection passage.

3. The electromagnetic relay according to claim 1, wherein the heat-radiation part is disposed near a movable contact of the electromagnetic relay main body with respect to an electromagnet of the electromagnetic relay main body.

4. The electromagnetic relay according to claim 1, wherein the heat-radiation part is disposed near the connection passage.

* * * * *